US006515410B2

(12) United States Patent
Sakamoto et al.

(10) Patent No.: US 6,515,410 B2
(45) Date of Patent: Feb. 4, 2003

(54) COLOR CATHODE RAY TUBE

(75) Inventors: Hirotsugu Sakamoto, Chiba (JP); Tomoki Nakamura, Mobara (JP); Shinichi Kato, Mobara (JP)

(73) Assignees: Hitachi Ltd., Chiba-Ken (JP); Hitachi Device Engineering Co. Ltd, Mobara (JP)

( * ) Notice: Subject to any disclaimer, the term of this patent is extended or adjusted under 35 U.S.C. 154(b) by 90 days.

(21) Appl. No.: 09/848,008

(22) Filed: May 3, 2001

(65) Prior Publication Data

US 2001/0043039 A1 Nov. 22, 2001

(30) Foreign Application Priority Data

May 19, 2000 (JP) ..... 2000-147406

(51) Int. Cl.[7] ..... H01J 29/50

(52) U.S. Cl. ..... 313/414; 313/461

(58) Field of Search ..... 313/412, 413, 313/414, 415, 426, 461

*Primary Examiner*—Vip Patel

(74) *Attorney, Agent, or Firm*—Milbank, Tweed, Hadley & McCloy LLP

(57) ABSTRACT

The present invention provides a flat-panel type color cathode ray tube which has the favorable focusing characteristics and can shorten the total length thereof. The color cathode ray tube includes an evacuated envelope which is constituted of a panel 1 which has a diagonal effective diameter of approximately 51 cm, a neck 3 which houses an electron gun 10 and a funnel 3 which connects the panel and the neck. The electron gun 10 includes a cathode, a first electrode, a second electrode, a focusing electrode and an anode electrode. Assuming the equivalent radius of curvature in the X direction of an inner surface of the panel 1 as Rix and the equivalent radius of curvature in the Y direction of an inner surface of the panel 1 as Riy, the distance Lm between the cathode and a screen-side end portion of the focusing electrode is set to 37 mm≦Lm≦45 mm.

3 Claims, 4 Drawing Sheets

COLOR CATHODE RAY TUBE

BACKGROUND OF THE INVENTION

1. Field of the Invention

The present invention relates to a color cathode ray tube, and more particularly to an improvement of focusing characteristics of a color cathode ray tube which has an inner surface of a panel thereof flattened.

2. Description of the Related Art

In a color cathode ray tube used in a television receiver or a personal computer or the like, a panel which forms a screen has inner and outer surfaces thereof formed in a curved surface.

FIG. 6 is a cross-sectional view of a schematic structure of a conventional color cathode ray tube. The color cathode ray tube includes an evacuated envelope which is constituted of a panel 1 which forms a phosphor screen on an inner surface thereof, a neck 3 which houses an electron gun and a funnel 2 which connects the panel 1 and the neck 3.

Both inner and outer surfaces of the panel 1 have the radii of curvature of approximately $1.35\times10^3$ mm. A shadow mask (omitted from the drawing) which constitutes a color selection electrode is arranged close to the screen formed on the inner surface of the panel 1. In the drawing, Rix indicates an equivalent radius of curvature in the horizontal direction of the inner surface of the panel 1 and Riy indicates an equivalent radius of curvature in the vertical direction of the inner surface of the panel 1.

An electron gun 10 which irradiates three electron beams in the direction toward the screen is housed in the inside of the neck 3. A deflection yoke 11 for deflecting these three electron beams irradiated from the electron gun 10 in the X direction (horizontal direction) and the Y direction (vertical direction) of the screen is mounted on a transitional region between the funnel 2 and the neck 3 of the evacuated envelope. Here, Z-Z indicates a tube axis of the color cathode ray tube.

The contour of the panel 1 is of an approximately rectangular shape having a long axis in the X direction and a short axis in the Y direction. A display region AR is formed on a front surface of the panel 1. The electron beams irradiated from the electron gun 10 are deflected from the center of the deflection magnetic field formed by a deflection yoke (deflection center) 12 by an effective maximum deflection angle θ.

The focusing characteristics of the electron beams on the screen exert the influence to the quality of a reproduced image. The electron gun 10 includes a cathode, an electron beam generating part made of a first electrode and a second electrode which are arranged in sequence from the cathode to the screen side and a focusing electrode and an anode electrode which are arranged in sequence at the screen side of the electron beam generating part.

As parameters which determine the focusing characteristics, the electrode length Lm of the electron gun 10, the distance Lc between the electron gun 10 and the screen, the distance (Lw/cos θ) between the deflection center and an outermost point of the effective display region and the distance Ld between an anode-side end portion of the focusing electrode and the deflection center 12 are considered.

Here, it is necessary to set the distance Ld to not less than a given distance which can prevent the electron gun 10 from being influenced by the deflection magnetic field. Further, the longer the electrode length Lm of the electron gun 10, the focusing characteristics is improved.

Recently, in the field of color cathode ray tubes also, so-called flat-face type or flat-panel type color cathode ray tubes which have outer surfaces of panels thereof approximately flattened have been widely adopted.

As a prior art which relates to this flat-panel type (hereinafter also called flat-face panel type) color cathode ray tube, for example, Japanese Laid-open Patent Publication 64451/1998 can be named.

With respect to the color cathode ray tube which has the inner and outer surfaces of the panel flattened, the further enhancement of the focusing characteristics has been requested. This is because that by flattening the inner surface of the panel, an incident angle of the electron beam on the panel becomes large at a peripheral portion of the screen and hence, the focusing characteristics are deteriorated.

Further, with respect to a television receiver or an equipment such as an information terminal of a personal computer or the like, in addition to the demand for the enlargement of the screen size (magnitude of the screen), the shortening of the depth size has been demanded. Particularly, the color cathode ray tube whose maximum deflection angle of electron beam becomes 90° has an elongated funnel portion and hence, it is difficult to shorten the depth size of the color cathode ray tube. Further, it is also difficult to shorten the distance between the inner surface of the panel and the screen-side end face of the focusing electrode. Still further, it is also difficult to elongate the electrode length of the electron gun.

So long as the electrode length of the electron gun is held at a large value, the total length of the color electron gun becomes long and hence, it is difficult to satisfy the demand for the shortening of the depth size.

SUMMARY OF THE INVENTION

The distance Lc between the electron gun and the screen can be expressed by a following equation when the equivalent radii of curvature in the X direction and in the Y direction of the inner surface of the panel are set to Rix and Riy.

$$Lc=Lw+Ld+Rix-\sqrt{((Rix-Riy+\sqrt{(Riy^2-150^2)})^2-200^2)}$$

In the present invention, by making the equivalent radii Rix, Riy in the X direction and in the Y direction of the inner surface of the panel large, the distance Lc between the electron gun and the screen is made small and the electrode length Lm of the electron gun is extended.

The present invention provides a flat-panel type color cathode ray tube which can overcome the above-mentioned drawbacks of prior art and can shorten the entire length while ensuring the favorable focusing characteristics.

DESCRIPTION OF THE PREFERRED EMBODIMENTS

Preferred embodiments of the present invention are explained in detail hereinafter in conjunction with drawings.

The focusing can be improved by elongating the electrode length Lm, by making the distance Lc between an electron gun and a screen small, and by making the distance (Lw/cos θ) between the deflection center and the outermost contour point of the effective display area small.

Provided that the effective screen size is equal to that of the conventional cathode ray tube and the deflection angle θ is equal to that of the conventional cathode ray tube, Lw/cos θ becomes equal to that of the conventional cathode ray tube.

Figure 1:
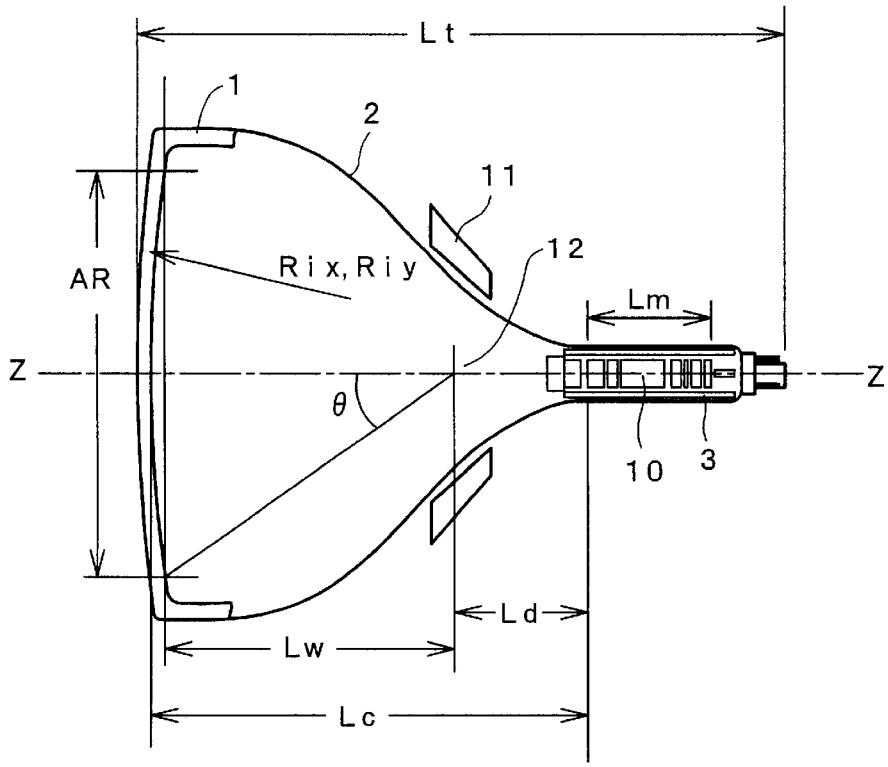
FIG. 1 is a cross-sectional view for schematically explaining the structure of a color cathode ray tube of the present invention.

FIG. 1 is a schematic cross-sectional view of a flat-panel type color cathode ray tube according to the present invention. This color cathode ray tube includes an evacuated envelope which is constituted of a panel 1 which forms a phosphor layer on an inner surface thereof, a neck 3 which houses an electron gun 10 and a funnel 2 which connects the panel 1 and the neck 2.

With respect to the panel 1 which constitutes the screen, the horizontal direction assumes an X direction, the vertical direction assumes a Y direction and an axis which intersects the X-Y plane perpendicularly assumes a Z axis.

The color cathode ray tube includes the panel 1 of a rectangular shape which has a long axis in the X direction and a short axis in the Y direction. In the inside of the neck 3, the electron gun 10 which irradiates three electron beams in the direction of the screen is housed.

This color cathode ray tube is a color cathode ray tube of nominal 21 inches whose panel 1 has a screen diagonal effective diameter of approximately 51 cm from a viewing side and an approximately flat outer surface.

The electron gun 10 housed in the neck 3 includes a cathode, an electron beam generating part made of a first electrode and a second electrode which are arranged in sequence from the cathode to the screen side, and a focusing electrode and an anode electrode which are arranged in sequence at a screen side of the electron beam generating part.

In FIG. 1, Lm indicates the distance between the cathode and the screen-side end face of the focusing electrode (here, called "electrode length of the electron gun") and numeral 12 indicates the deflection center. Lw indicates the distance between a vertical line extended downwardly from an outer periphery of an effective region AR of the screen and the deflection center 12, Ld indicates the distance between the deflection center 12 and the screen-side end face of the focusing electrode, and Lc indicates the distance on the tube axis Z-Z between the panel inner surface and the screen-side end face of the focusing electrode. Here, Lt indicates the total length along the Z-Z axis of the color cathode ray tube.

Further, Rix indicates an equivalent radius of curvature in the X direction on the inner surface of the panel 1 and Riy indicates an equivalent radius of curvature in the Y direction on the inner surface of the panel 1. Here, the definition of the equivalent radius of curvature is explained in conjunction with FIG. 2.

Figure 2:
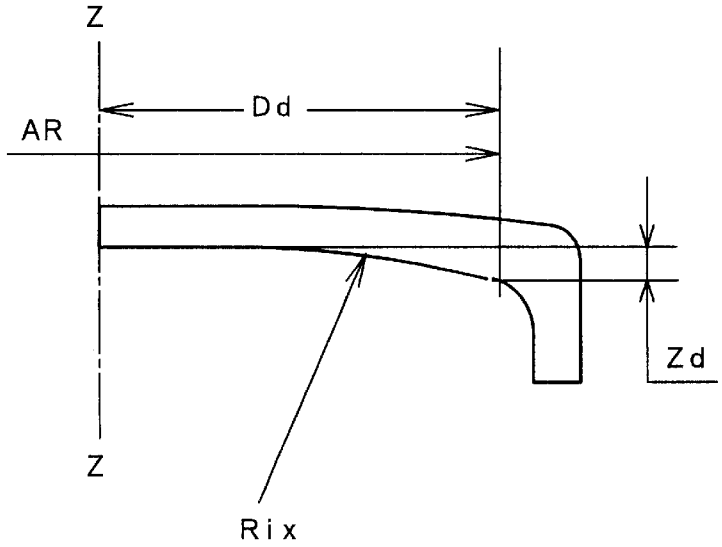
FIG. 2 is a partial cross-sectional view for explaining the definition of an equivalent radius of curvature of an inner surface of a panel.

FIG. 2 is a partial cross-sectional view for explaining the definition of the equivalent radius of curvature on the inner surface of the panel. When the curved inner surface of the panel is formed in an aspherical shape, the radius of curvature takes different values depending on arbitrary positions on the inner surface of the panel. Accordingly, the curvature in the X direction of the inner surface of the panel is defined by a following equation as the equivalent radius of curvature Rix (mm).

$$Rix=(Zd^2+Dd^2)2Zd$$

Here, Dd indicates the distance (mm) from the tube axis Z-Z of the inner surface of the panel to an end portion of the effective region of the screen and Zd indicates a fall amount (mm) in the tube axis Z-Z direction from the center of the inner surface of the panel at the end portion of the effective region of the screen (crossing point with the tube axis Z-Z).

The same goes for the case in which the X direction is replaced with the Y direction or the diagonal direction as well as in the case the inner surface of the panel is replaced with the outer surface of the panel. Further, even in the case that the panel is replaced with a shadow mask (press mask) which is curved in conformity with the curved surface of the inner surface of the panel, they can be defined in the same manner.

Depending on the screen size of the cathode ray tube, the panel exhibits the different feeling of flatness even when the radius of curvature of the outer surface of the panel is equal. Accordingly, to evaluate this feeling of flatness, a radius of curvature Ro (mm) of the outer surface and a radius of curvature Ri (mm) of the inner surface of the panel which are standardized irrespective of the screen size are respectively defined as follows.

$$Ro=42.5V+45.0$$

$$Ri=40.0V+40.0$$

Here, V indicates an effective diameter (inch) in the diagonal direction of the screen. Accordingly, the degree of flatness of the panel can be expressed by the multiple of the standardized radius of curvature Ro of the outer surface or the radius of curvature Ri of the inner surface. Here, "inch" which indicates the effective diameter is a term which is commonly used for expressing the screen size of the color cathode ray tube.

Figure 3:
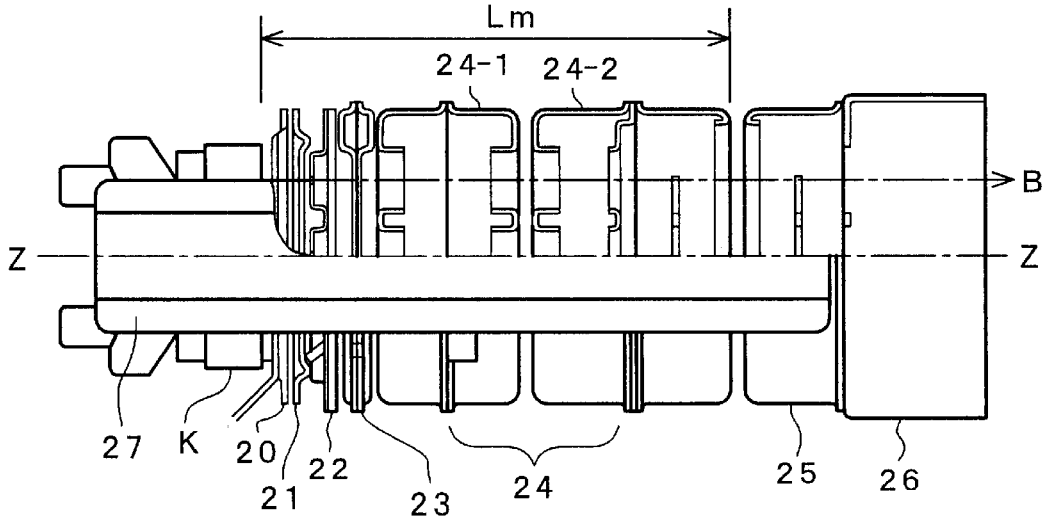
FIG. 3 is a side view including a partial cross-sectional view of an electron gun housed in a neck of a color cathode ray tube of the present invention.

FIG. 3 is a side view showing the electron gun of the color cathode ray tube of the present invention with a part in cross section. In the drawing, K indicates a cathode, numeral 20 indicates the first electrode and numeral 21 indicates the second electrode. The cathode K, the first electrode 20 and the second electrode 21 constitute the so-called electron beam generating part.

Various kinds of electrodes (a third electrode 22, a fourth electrode 23, a fifth electrode 24 and a sixth electrode 25) for forming a focusing lens and a main lens are arranged in sequence at a screen side of this electron beam generating part. Here, the sixth electrode 25 is also called an anode electrode. Further, numeral 26 indicates a shield cup and numeral 27 indicates a beading glass for fixing and holding respective electrodes in a given order and at a given interval.

In the electron gun of this embodiment, the focusing lens is constituted of the third electrode 22, the fourth electrode 23 and the fifth electrode 24 which is made of a divided 5-1 electrode 24-1 and a divided 5-2 electrode 24-2. The main lens is formed at a portion where the 5-2 electrode 24-2 and the sixth electrode 25 face each other in an opposed manner.

The electrode length Lm of the electron gun in this embodiment is the distance between the cathode 20 and the end face of the 5-2 electrode 24-2 at the sixth electrode 25 side.

In this embodiment, assuming the equivalent radius of curvature in the X direction of the inner surface of the panel 1 as Rix and the equivalent radius of curvature in the Y direction of the inner surface of the panel 1 as Riy, the distance (electrode length) Lm between the cathode K and the end face of the 5-2 electrode 24-2 at the sixth electrode 25 side is expressed by a following equation.

$$37 \leqq Lm \leqq 37+23.4-(Rix-\sqrt{((Rix-Riy+\sqrt{(Riy^2-150^2)})^2-200^2)})$$

Here, the fall amount (=Lc−Lw−Ld) of the inner surface of the conventional panel is 23.4 mm.

To be more specific, the equivalent radius of curvature Rix in the X direction of the inner surface of the panel 1 was set to 1990 mm and the equivalent radius of curvature Riy in the Y direction of the inner surface of the panel 1 was set to 1870 mm. As a result, the electrode length Lm can be set within the range of period 37≦Lm≦44.3.

In this embodiment, the radii of curvature Rix, Riy of the inner surface of the panel 1 have the relationship Rix≧Riy. Accordingly, the curvature of the dome-shaped shadow mask can be set to a curvature which suppresses the deformation of the shape thereof. Further, by setting the relationship between the equivalent radii of curvature Rix, Riy of the inner surface of the panel 1 to Rix≧Riy, the difference of panel plate thickness between the X-direction peripheral portion and the Y-direction peripheral portion can be reduced. As a result, images with the least distortion can be displayed. In this panel, since the radius of curvature of the inner surface in the X direction having a large deflection angle is larger than that in the Y direction, by carrying out the present invention, the focusing characteristics at the peripheral portion of the panel can be largely improved.

The flat-panel type color cathode ray tube has the large equivalent radius of curvature Rix in the X direction and the large equivalent radius of curvature Riy in the Y direction compared to a conventional curved-panel type color cathode ray tube. Accordingly, the flat-panel type color cathode ray tube can make the distance Lc on the tube axis Z-Z between the inner surface of the panel and the screen-side end surface of the focusing electrode which constitutes the main lens electrode small.

Within the range that this distance Lc is made small, the electrode length Lm of the electron gun can be elongated without increasing the tube axis direction length Lt.

With respect to a color cathode ray tube for monitor whose panel 1 with a shadow mask has a diagonal size of 51 cm, it is inevitable that the electrode length Lm of the electron gun is set to Lm≧35 mm to obtain the desired focusing characteristics.

Conventionally, the electrode length Lm of the electron gun had to be set to Lm≦37 mm due to the restriction derived from a monitor set. To the contrary, according to this embodiment, the electrode length Lm of the electron gun can be extended to Lm≦44.3 mm.

According to the present invention, in the 51 cm type color cathode ray tube whose maximum deflection angle of electron beams is set to 90 degrees, the focusing characteristics can be enhanced and the total length in the tube axis direction can be suppressed to 447 mm.

As a result, it becomes possible to provide the flat-panel type color cathode ray tube which has the favorable focusing characteristics and can shorten the total length thereof.

Further, since the maximum deflection angle of electron beams in the color cathode ray tube of this embodiment is set to 90 degrees, the electric consumption of a deflection yoke is small compared to a cathode ray tube whose maximum deflection angle is set to 100 degrees. Further, the effective screen size is equal to that of the conventional cathode ray tube, the deflection angle θ is equal to that of the conventional cathode ray tube and the electrode length of the electron gun can be made longer than that of the conventional electron gun and hence, the focusing characteristics are enhanced.

Figure 4:
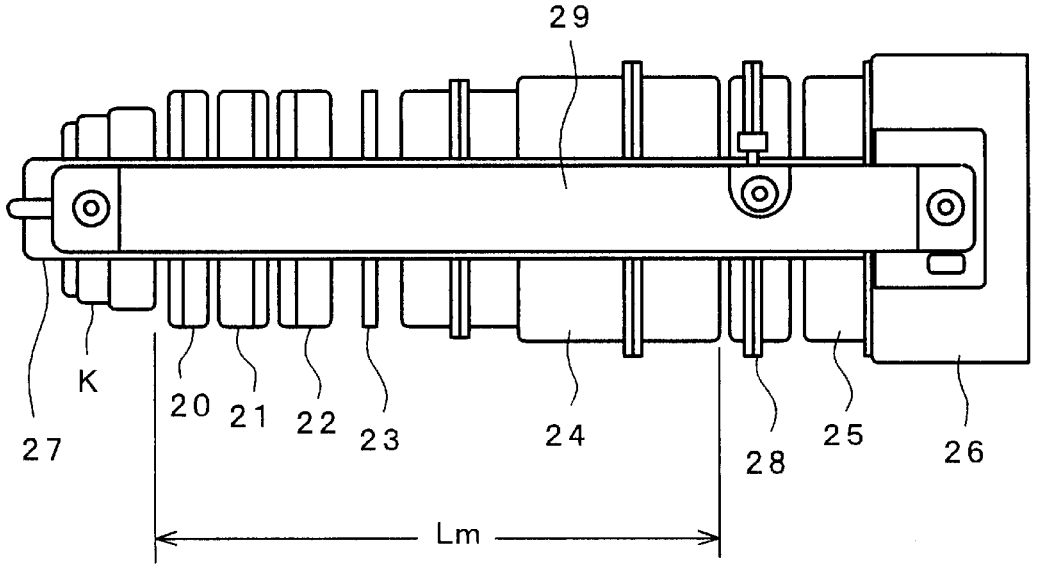
FIG. 4 is a partial cross-sectional view of an electron gun which is housed in a neck of a color cathode ray tube of the second embodiment of the present invention.

FIG. 4 is a side view with a part in cross section of an electron gun of the second embodiment of the present invention. In the drawing, symbols which are equal to those of FIG. 3 correspond to identical functional portions. Also in the drawing, numeral 28 indicates an intermediate electrode and numeral 29 indicates a built-in resistance element.

In the electron gun of this embodiment, a cathode K, a first electrode 20 and a second electrode 21 constitute a so-called electron beam generating part. Various kinds of electrodes (a third electrode 22, a fourth electrode 23, a fifth electrode 24 which constitutes an anode electrode) for forming a focusing lens and a main lens are arranged in sequence in the screen direction of the electron beam generating part. Further, the intermediate electrode 28 is arranged at the front stage of the sixth electrode 25 (between the fifth electrode 24 and the sixth electrode 25).

Further, the built-in resistance element 29 is mounted on a beading glass 27 for fixing and holding respective electrodes in a given order and at a given interval to provide a power source having a potential slightly lower than that of the sixth electrode and this power source supplies electricity to the intermediate electrode 28.

The electrode length Lm of the electron gun in this embodiment is the distance between the cathode 20 and the end face of the fifth electrode 24 at the intermediate electrode 28 side.

In this embodiment also, as in the case of the previous embodiment shown in FIG. 3, it becomes possible to extend the electrode length Lm of the electron gun to Lm≦44.3 mm. When the color cathode ray tube for monitoring with the panel 1 having the diagonal size of 51 cm is formed into a flat panel, the focusing characteristics of the electron gun can be enhanced and hence, the total length in the tube axis direction can be suppressed to 447 mm. As a result, it becomes possible to provide the flat-panel type color cathode ray tube which has the favorable focusing characteristics and can shorten the total length thereof.

Figure 5:
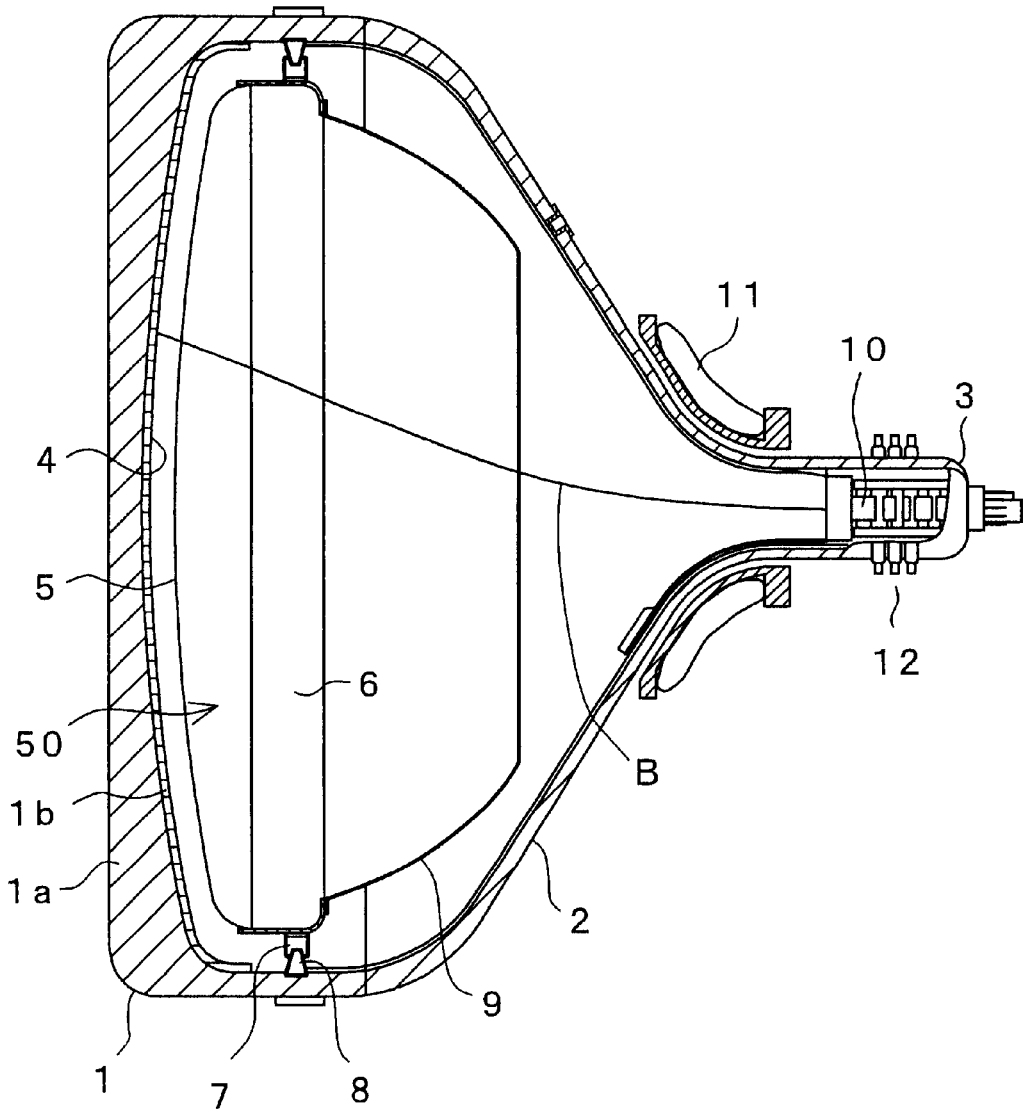
FIG. 5 is a cross-sectional view for explaining the entire constitution of the color cathode ray tube of the present invention.
Figure 6:
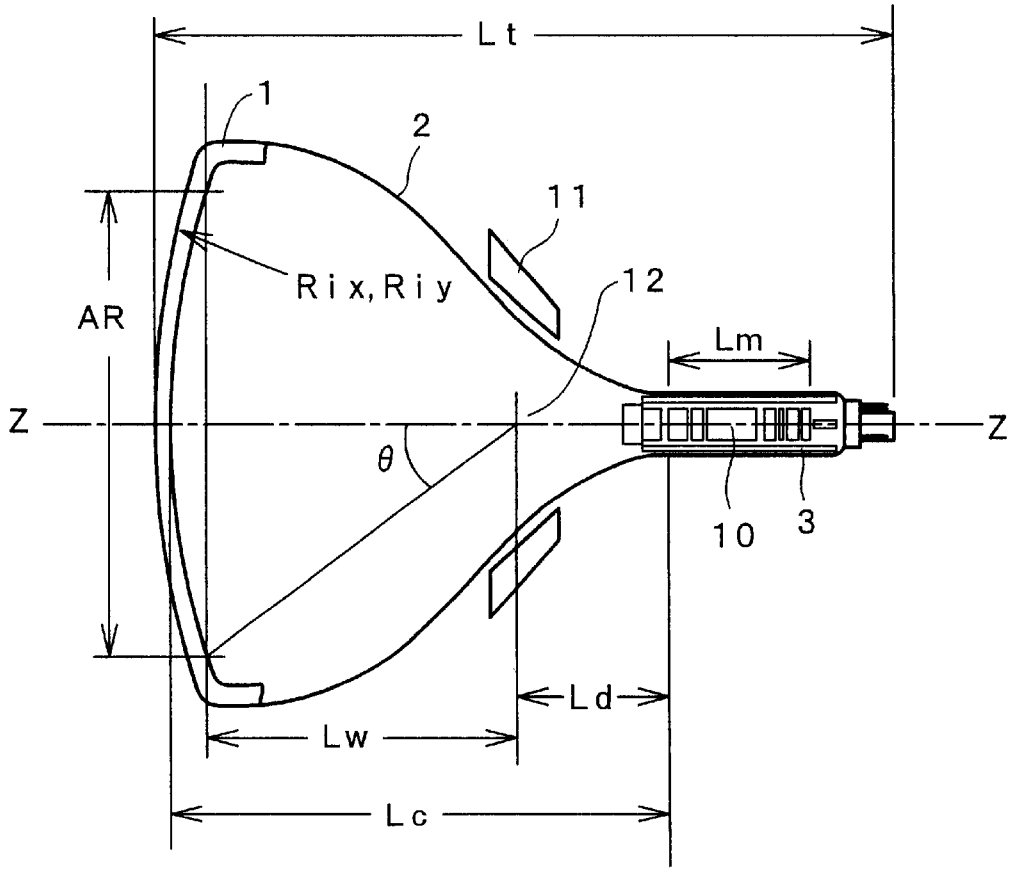
FIG. 6 is a cross-sectional view for schematically explaining a general structure of a conventional color cathode ray tube.

FIG. 5 is a schematic cross-sectional view for explaining the entire constitution of the color cathode ray tube according to the present invention. This color cathode ray tube is a flat-panel type color cathode ray tube in which the equivalent radius of curvature of an outer surface 1*a* of a panel 1 is larger than the equivalent radius of curvature of an inner surface 1*b* of the panel 1.

Phosphors 4 of three colors are coated on the inner surface 1*b* of the panel 1 to form a screen. A shadow mask structure 50 is arranged close to the screen 4. The shadow mask structure 50 is produced by welding a shadow mask 5 which is formed of an Invar member having a thickness of 0.13 mm by press forming to a mask frame 6 made of iron-based metal having a thickness of 1.1 mm, for example. Suspension mechanisms 7 having spring members are mounted on a side surface of the mask frame 6 and these suspension mechanisms 7 are engaged with stud pins 8 embedded in an inner wall of the mask 1 so as to mount the shadow mask at a given position.

The panel 1 is adhered to a large diameter opening of the funnel 2 and the small diameter side of funnel 2 is connected to the neck 3. In the inside of the neck 3, an electron gun 10 which irradiates three electron beams B is housed. This electron gun 10 is either one of electron guns explained in conjunction with FIG. 3 and FIG. 4.

An external magnetic device 12 for color purity correction and the like is mounted on the periphery of the neck 3. Further, a deflection yoke 11 is exteriorly mounted on a transitional region between the funnel 2 and the neck 3 so as to deflect the electron beams B in the X direction and in the Y direction so that two-dimensional images are reproduced on the screen 4. A magnetic shield 9 which shields the electron beams B from an external magnetism such as the earth magnetism is fixedly secured to the neck side of the mask frame 6.

According to the embodiments of the present invention, the flat-panel type color cathode ray tube which has the favorable feeling of flatness and can enhance the focusing characteristics can be realized.

As has been described heretofore, according to the present invention, it becomes possible to provide the color cathode ray tube which can make the equivalent radius of curvature of the outer surface of the panel larger than that of the inner surface of the panel and can extend the electrode length of the electron gun without extending the total length, and can enhance the focusing characteristics.

The present invention is not limited to the above mentioned constitutions and it is needless to say that various modifications can be considered without departing from the technical concept of the present invention.

We claim:

1. A color cathode ray tube including an evacuated envelope constituted of a panel which forms a phosphor screen on an inner surface thereof, a neck which houses an electron gun and a funnel which connects the panel and the neck, wherein the panel has an approximately rectangular screen which has a long axis in the X direction and a short axis in the Y direction and the diagonal effective diameter of the screen is set to approximately 51 cm, the electron gun housed in the neck includes an electron beam generating part which is made of a cathode and first electrode and second electrode which are arranged in sequence from the cathode to the screen side, and a focusing electrode and an anode electrode which are arranged in sequence at the screen side of the electron beam generating part, assuming the equivalent radius of curvature in the X direction of the inner surface of the panel as Rix and the equivalent radius of curvature in the Y direction of the inner surface of the panel as Riy, the distance Lm between the cathode and a screen-side end portion of the focusing electrode which constitutes the main lens is set to a following value.

$$37 \leqq Lm \leqq 37+23.4-(Rix-\sqrt{((Rix-Riy+\sqrt{(Riy^2-150^2)})^2-200^2)}).$$

2. A color cathode ray tube according to claim 1, wherein the equivalent radii of curvature in the X direction and in the Y direction of an outer surface of the panel are both set to not less than $1\times10^4$ mm.

3. A color cathode ray tube according to claim 1, wherein the equivalent radii of curvature in the X direction and the Y direction of the outer surface of the panel are both set to not less than $1\times10^4$ mm and the relationship between the equivalent radii of curvature Rix, Riy in the X direction and the Y direction of the inner surface of the panel is set to $Rix \geqq Riy$.

* * * * *